US006944510B1

(12) United States Patent
Ballesty et al.

(10) Patent No.: US 6,944,510 B1
(45) Date of Patent: Sep. 13, 2005

(54) AUDIO SIGNAL TIME SCALE MODIFICATION

(75) Inventors: Darragh Ballesty, Dublin (IE); Richard D. Gallery, Dublin (IE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/575,607

(22) Filed: May 22, 2000

(30) Foreign Application Priority Data

May 21, 1999 (GB) ..... 9911737

(51) Int. Cl.[7] ..... G06F 17/00
(52) U.S. Cl. ..... 700/94; 381/119
(58) Field of Search ..... 700/94; 381/119; 704/213; 84/649

(56) References Cited

U.S. PATENT DOCUMENTS

| | | | | |
|---|---|---|---|---|
| 4,689,697 A | | 8/1987 | Wilkinson | 360/19.1 |
| 5,216,744 A | | 6/1993 | Alleyne et al. | 395/2 |
| 5,641,927 A | * | 6/1997 | Pawate et al. | 84/609 |
| 5,842,172 A | | 11/1998 | Wilson | 704/503 |
| 6,092,040 A | * | 7/2000 | Voran | 704/228 |
| 6,266,003 B1 | * | 7/2001 | Hoek | 341/155 |

FOREIGN PATENT DOCUMENTS

| | | | |
|---|---|---|---|
| EP | 0392049 A1 | 10/1990 | G11B 20/00 |
| EP | 0865026 A2 | 9/1998 | G10L 3/02 |

OTHER PUBLICATIONS

"Non-Parametric Techniques for Pitch Scale and Time Scale Modification of Speech", by E. Moulines an DJ. Laroche, Speech Communications, vol. 16, 1995, pp. 175-205.

"An Edge Detection Method for Time-Scale Modification of Acoustic Signals", by Rui Ren, Hongkong University of Science and Technology, Computer Science Dept. Viewed at : HTTP://WWW.CS.UST./HK/~RREN/SOUND_TECH/tsm_PAPER_LONG.HTM.

"High Quality Time-Scale Modification for Speech", by S. Roucos and A. Wigus, IEEE Int'l Conf. on Acoustics, Speech and Signal Processing, Mar. 1985, pp. 493-496.

"Computationally Efficient Algorithm for Time-Scale Modification (GLS-TSM)" by S. Yim and B.I. Pawate, IEEE Int'l Conf. on Acoustics, Speech and Signal Processing, 1996.

(Continued)

*Primary Examiner*—Xu Mei
*Assistant Examiner*—Con P. Tran
(74) *Attorney, Agent, or Firm*—Michael E. Belk

(57) ABSTRACT

A method of time-scale modification processing of frame-based digital audio signals based on Synchronous Overlap Addition in which an original frame of digital audio is copied, the original and copied frames are partly overlapped to give a desired new duration to within a predetermined tolerance, the extent of overlap is adjusted within the predetermined tolerance by reference to a cross correlation determination of the best match between the overlapping portions of the original and copied frame; and a new audio frame is generated from the non-overlapping portions of the original and copied frame and by cross-fading between the overlapping portions. To reduce the computational load, a profiling procedure is applied to the original and copied frame prior to cross correlation, such as to reduce the specification of each audio frame portion (100) to a finite array of values (101–106), and the cross correlation is then performed in relation only to the pair of finite arrays of values. To further simplify computation, the values (101–106) are identified as maxima or minima for the signal and are both stored and processed as the only non-zero values in a matrix representation of the frame. A digital signal processing apparatus embodying this technique is also provided.

20 Claims, 5 Drawing Sheets

OTHER PUBLICATIONS

"Time-Scale" Modification of Speech by Zero-Crossing Rate Overlap-Add (ZCR-OLA) by B. Lawlor and A. Fagan, IEEE Int'l Conf. on Acoustics, Speecha nd Siganl Processing.

* cited by examiner

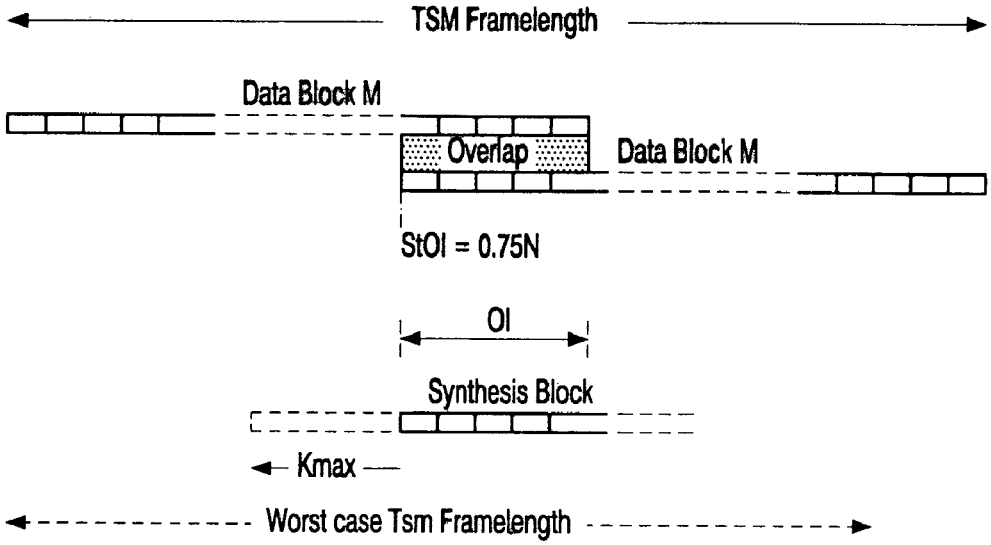
FIG. 6
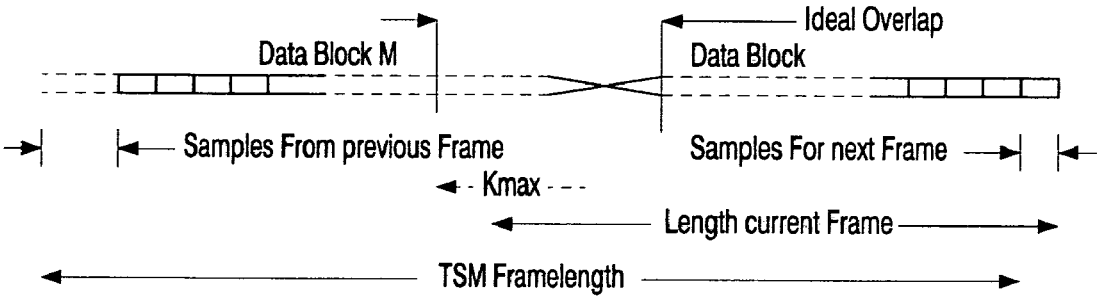
FIG. 7
| Analysis Ap | | Synthesis Sp | |
|---|---|---|---|
| Magnitude | Location | Magnitude | Location |
| Val0 | 12 | Val0 | 11 |
| Val1 | 27 | Val1 | 24 |
| Val2 | 67 | Val2 | 45 |
| * | -1 | Val3 | 58 |
| | | Val4 | 66 |
| | | Val5 | 73 |
| | | * | -1 |
FIG. 8

| Iteration | D_array | d_count | D loc | d_gate | nd_array | nd_count | Nd_gate | D loc | Action |
|---|---|---|---|---|---|---|---|---|---|
| 1 | Ap | 0 | 12 | 0 | Sp | 1 | 1 | 12 | Multiply magnitude and chose new driving array |
| 1. new driving array decision | | 1 | 27 | | | 1 | | 25 | Driving array stays the same |
| 2 | Ap | 1 | 27 | 0 | Sp | 1 | 1 | 25 | not the same |
| 2. driver loc is les than non driver | | | 27 | | | 2 | | 46 | Change driving array |
| 3 | Sp | 2 | 46 | 1 | Ap | 1 | 0 | 27 | Not same, increment non driving array |
| 3. | | | 46 | | | 2 | | 67 | Change driving array |
| 4. | Ap | 2 | 67 | 0 | Sp | 2 | 1 | 46 | Increment count for non-driver |
| 4 | | | 67 | | | 3 | | 59 | |
| 5 | Ap | 2 | 67 | 0 | Sp | 3 | 1 | 59 | Increment non driver count |
| | | | 67 | | | 4 | | 67 | |
| 6 | Ap | 2 | 67 | 0 | Sp | 4 | 1 | 67 | Multiply |
| 6 | | 3 | -1 | | | 5 | | 74 | Incrementi ng both brings conclusion: null termination. |

FIG. 9

AUDIO SIGNAL TIME SCALE MODIFICATION

The present invention relates to methods for treatment of digitised audio signals (digital stored sample values from an analogue audio waveform signal) and, in particular (although not exclusively) to the application of such methods to extending the duration of signals during playback whilst maintaining or modifying their original pitch. The present invention further relates to digital signal processing apparatus employing such methods.

The enormous increase in multimedia technologies and consumer expectation for continually higher standards from home audio and video systems has led to a growth in the number of features available on home multimedia products. These features are vital for product differentiation in an area that is extremely cost sensitive, and so new features are usually constrained with critical CPU and memory requirements.

One such feature is slow motion audio based around a Time Scale Modification (TSM) algorithm that stretches the time content of an audio signal without altering its spectral (or pitch) content. Time scaling algorithms can either increase or decrease the duration of the signal for a given playback rate. They have application in areas such as digital video, where slow motion video can be enhanced with pitch-maintained slow motion audio, foreign language learning, telephone answering machines, and post-production for the film industry.

TSM algorithms fall into three main categories, time domain approaches, frequency domain approaches, and parametric modelling approaches. The simplest (and most computationally efficient) algorithms are time domain ones and nearly all are based on the principal of Overlap Add (OLA) or Synchronous Overlap Add (SOLA), as described in "Non-parametric techniques for pitch scale and time scale modification of speech" by E. Moulines and J. Laroche, Speech Communications, Vol. 16, 1995, pp 175–205, and "An Edge Detection Method for Time Scale Modification of Accoustic Signals" by Rui Ren of the Hong Kong University of Science & Technology Computer Science Department, viewed at http://www.cs.ust.hk/~rren/sound_tech/TSM_Paper_Long.htm. In OLA, a short time frame of music or speech containing several pitch periods of the fundamental frequency has a predetermined length: to increase this, a copy of the input short time frame is overlapped and added to the original, with a cross-fade applied across this overlap to remove discontinuities at the block boundaries, as will be described in greater detail hereinafter with reference to FIGS. 2, 3 and 4. Although the OLA procedure is simple and efficient to implement, the resulting quality is relatively poor because reverberation effects are introduced at the frame boundaries (splicing points). These artefacts are a result of phase information being lost between frames.

To overcome these local reverberations, the SOLA technique was proposed by S. Roucos and A. Wilgus in "High Quality Time-Scale Modification for Speech", IEEE International Conference on Acoustics, Speech and Signal Processing, March 1985, pp 493–496. In this proposal, a rectangular synthesis window was allowed to slide across the analysis window over a restricted range generally related to one pitch period of the fundamental. A normalised cross correlation was then used to find the point of maximum similarity between the data blocks. Although the SOLA algorithm produces a perceptually higher quality output, the computational cost required to implement the normalised cross correlation make it impractical for systems where memory and CPU are limited.

It is an object of the present invention to provide a signal processing technique (and an apparatus employing the same) which, whilst based on SOLA techniques, provides a similar quality at a lower computational cost.

In accordance with the present invention there is provided a method of time-scale modification processing of frame-based digital audio signals wherein, for each frame of predetermined duration: the original frame of digital audio is copied; the original and copied frames are partly overlapped to give a desired new duration to within a predetermined tolerance; the extent of overlap is adjusted within the predetermined tolerance by reference to a cross correlation determination of the best match between the overlapping portions of the original and copied frame; and a new audio frame is generated from the non-overlapping portions of the original and copied frame and by cross-fading between the overlapping portions;

characterised in that a profiling procedure is applied to the overlapping portions of the original and copied frame prior to cross correlation, which profiling procedure reduces the specification of the respective audio frame portions to respective finite arrays of values, and the cross correlation is then performed in relation only to the pair of finite arrays of values. By the introduction of this profiling procedure, the volume of data to be handled by the computationally intensive cross correlation is greatly reduced, thereby permitting implementation of the technique by systems having lower CPU and/or memory capability than has heretofore been the case.

For the said overlapping portions the profiling procedure suitably identifies periodic or aperiodic maxima and minima of the audio signal portions and places these values in the respective arrays. For further ease of processing, the overlapping portions may each be specified in the form of a respective matrix having a respective column for each audio sampling period within the overlapping portion and a respective row for each discrete signal level specified, with the cross correlation then being applied to the pair of matrices. A median level may be specified for the audio signal level, with said maxima and minima being specified as positive or negative values with respect to this median value.

To reduce computational loading, prior to cross correlation, at least one of the matrices may be converted to a one-dimensional vector populated with zeros except at maxima or minima locations for which it is populated with the respective maxima or minima magnitude.

In the current implementation, the maximum predetermined tolerance within which the overlap between the original and copied frames may be adjusted suitably, has been restricted to a value based on the pitch period (as will be described in detail hereinafter) of the audio signal for the original frame to avoid excessive delays due to cross correlation. Where the aforesaid median value is specified, the maxima or minima may be identified as the greatest recorded magnitude of the signal, positive or negative, between a pair of crossing points of said median value: a zero crossing point for said median value may be determined to have occurred when there is a change in sign between adjacent digital sample values or when a signal sample value exactly matches said median value.

Also in accordance with the present invention there is provided a digital signal processing apparatus arranged to apply the time scale modification processing method recited above to a plurality of frames of stored digital audio signals, the apparatus comprising storage means arranged to store said audio frames and a processor programmed, for each frame, to perform the steps of:

copying an original frame of digital audio and partly overlapping the original and copied frames to give a desired new duration to within a predetermined tolerance;

adjusting the extent of overlap within the predetermined tolerance by applying a cross correlation to determine the best match between the overlapping portions of the original and copied frame; and generating a new audio frame from the non-overlapping portions of the original and copied frame and by cross-fading between the overlapping portions;

characterised in that the processor is further programmed to apply a profiling procedure to the overlapping portions of the original and copied frame prior to cross correlation to reduce the specification of the respective audio frame portions to respective finite arrays of values, and apply the cross correlation in relation only to the pair of finite arrays of values.

Further features and preferred embodiments of the present invention will now be described, by way of example only, and with reference to the accompanying drawings, in which:

FIG. 6 represents overlap addition for a pitch increase;

FIG. 7 illustrates movement of samples for Time Scale Modification buffer management;

FIG. 8 is a table of sample values for analysis and synthesis blocks in a sparse cross correlation; and FIG. 9 illustrates in tabular form the progress of a further simplified cross correlation procedure.

Figure 1:
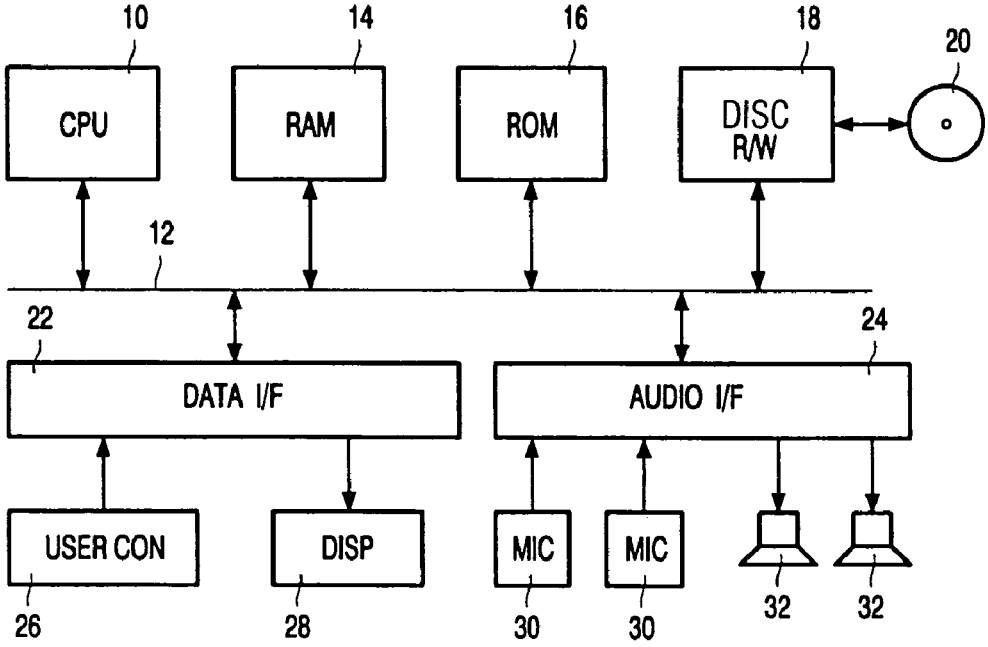
FIG. 1 is a block schematic diagram of a programmable data processing apparatus suitable to host the present invention.

FIG. 1 represents a programmable audio data processing system, such as a karaoke machine or personal computer. The system comprises a central processing unit (CPU) 10 coupled via an address and data bus 12 to random-access (RAM) and read-only (ROM) memory devices 14, 16. The capacity of these memory devices may be augmented by providing the system with means 18 to read from additional memory devices, such as a CD-ROM, which reader 18 doubles as a playback deck for audio data storage devices 20.

Also coupled to the CPU 10 via bus 12 are first and second interface stages 22, 24 respectively for data and audio handling. Coupled to the data interface 22 are user controls 26 which may range from a few simple controls to a keyboard and a cursor control and selection device such as a mouse or trackball for a PC implementation. Also coupled to the data interface 22 are one or more display devices 28 which may range from a simple LED display to a display driver and VDU.

Coupled to the audio interface 24 are first and second audio inputs 30 which may (as shown) comprise a pair of microphones. Audio output from the system is via one or more speakers 32 driven by an audio processing stage which may be provided as dedicated stage within the audio interface 24 or it may be present in the form of a group of functions implemented by the CPU 10; in addition to providing amplification, the audio processing stage is also configured to provide a signal processing capability under the control of (or as a part of) the CPU 10 to allow the addition of sound treatments such as echo and, in particular, extension through TSM processing.

Figure 2:
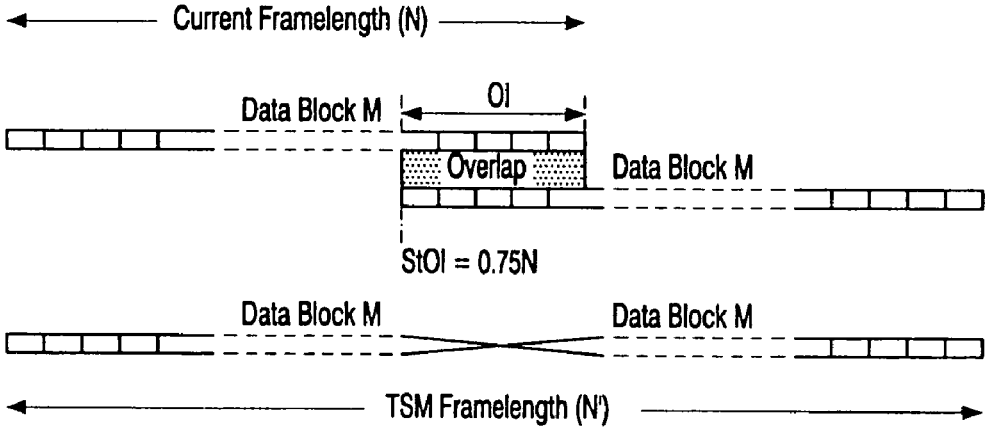
FIG. 2 PRIOR ART
FIG. 2 illustrates the known Overlap Addition (OLA) time extension process.
Figure 3A:
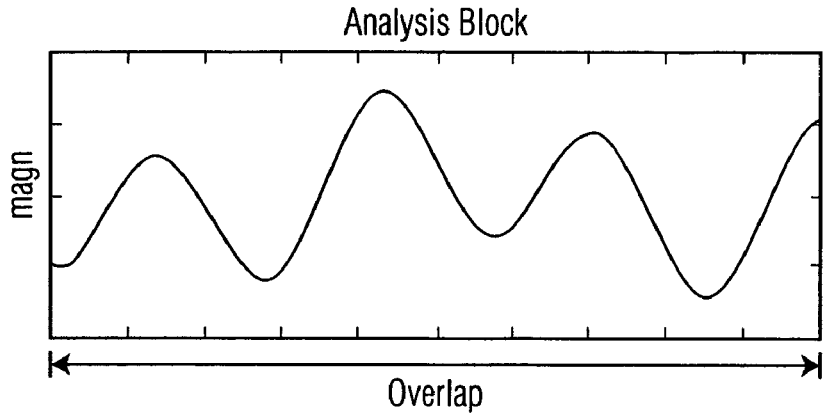
FIG. 3a PRIOR ART
FIG. 3 illustrates the matching of audio signal segments from a pair of overlapping copies of an audio file.
Figure 3B:
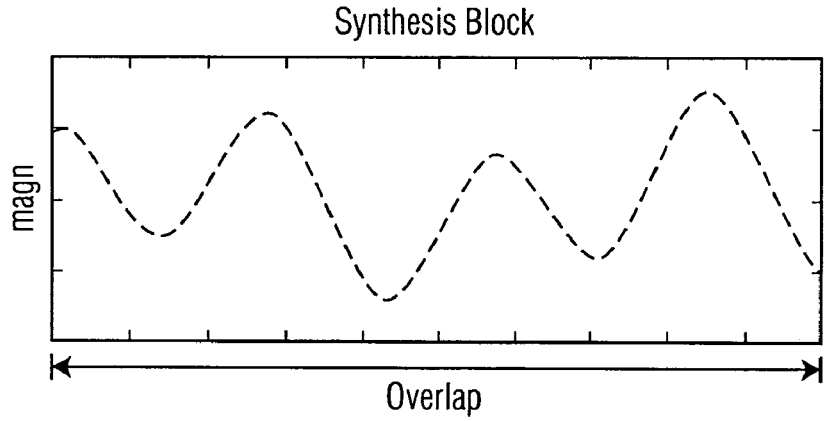
FIG. 3b PRIOR ART
Figure 3C:
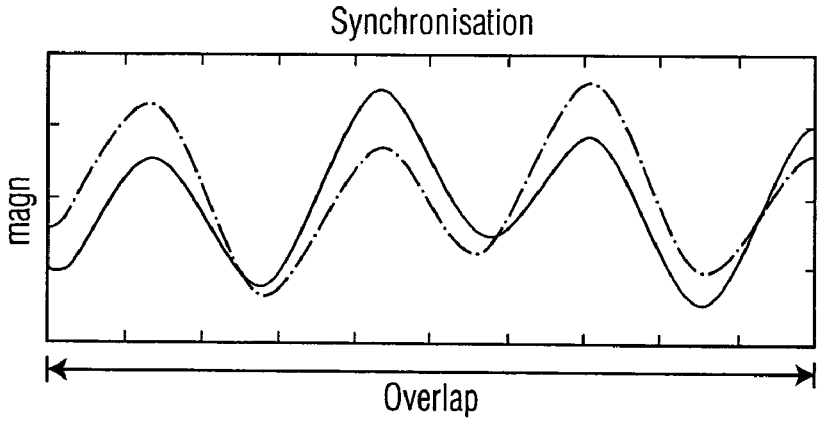
FIG. 3c PRIOR ART
Figure 4:
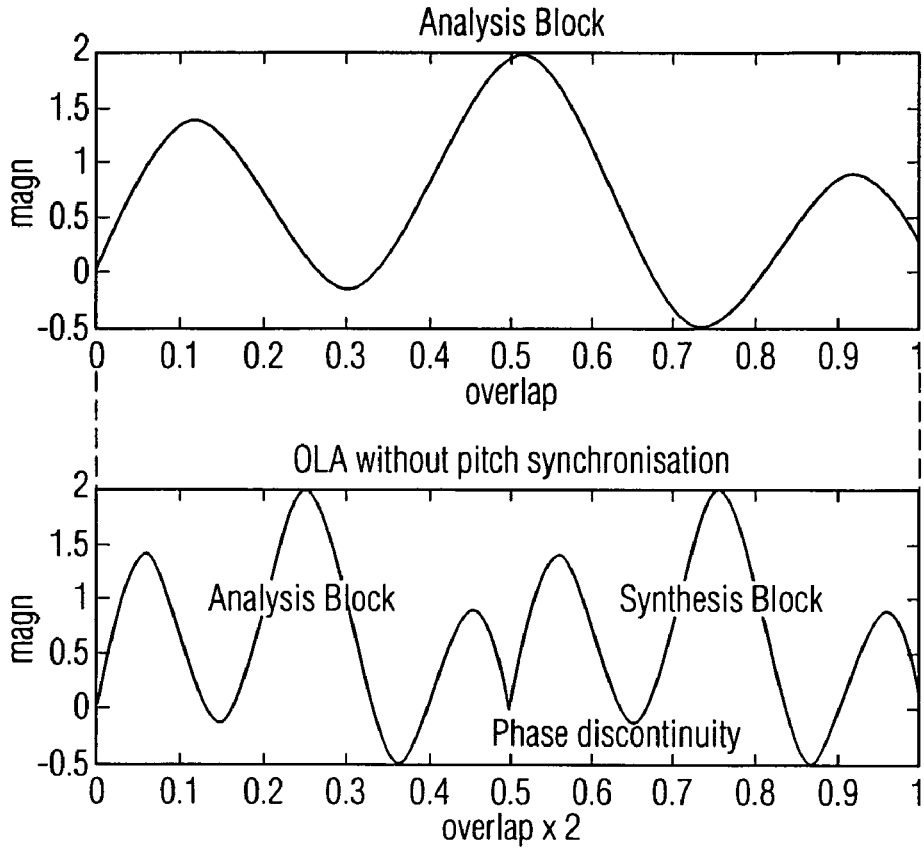
FIG. 4 PRIOR ART
FIG. 4 represents the loss of phase information at the overlap boundary for the signal segments of FIG. 3.

By way of example, it will be useful to initially summarise the basic principles of OLA/SOLA with reference to FIGS. 2, 3 and 4 before moving onto a description of the developments and enhancements of the present invention.

Considering first a short time frame of music or speech containing several pitch periods of the fundamental frequency, and let it's length be N samples. To increase the length from N to N' (say 1.75N), a copy of the input short time frame (length N) is overlapped and added to the original, starting at a point StOI. For the example N'=1.75N, StOI is 0.75N. This arrangement is shown in FIG. 2. The shaded region is the overlap between the data blocks (length OI) and, as can be seen from the lower trace, a linear cross fade is applied across this overlap to remove discontinuities at the block boundaries.

Although the OLA procedure is simple and efficient to implement, the resulting quality is relatively poor because reverberation effects are introduced at the frame boundaries (splicing points). These artefacts are a result of phase information being lost between frames.

In the region of the overlap we define the following. The analysis block is the section of the original frame that is going to be faded out. The synthesis block is the section of the overlapping frame that is going to be faded in (i.e. the start of the audio frame). The analysis and synthesis blocks are shown in FIG. 3 at (a) and (b) respectively. As can be seen, both blocks contain similar pitch information, but the synthesis block is out of phase with the analysis block. This leads to reverberation artefacts, as mentioned above, and as shown in FIG. 4.

To overcome these local reverberations, the SOLA technique may be applied. In this technique, a rectangular synthesis window is allowed to slide across the analysis window over a restricted range $[0, K_{max}]$ where $K_{max}$ represents one pitch period of the fundamental. A normalised cross correlation is then used to find the point of maximum similarity between the data blocks. The result of pitch synchronisation is shown by the dashed plot in FIG. 3 at (c). The synthesis waveform of (b) has been shifted to the left to align the peaks in both waveforms.

As mentioned previously, although the SOLA algorithm produces a perceptually high quality output, the computational cost required to implement the normalised cross correlation make it impractical to implement for systems where CPU and memory are limited. Accordingly, the present applicants have recognised that some means is required for reducing the complexity of the process to allow for its implementation in relatively lower powered systems.

The normalised cross correlation used in the SOLA algorithm has the following form:

$$R(k) = \frac{\sum_j x_j \times y_{j+k}}{\sqrt{\left(\sum_j x_j^2\right) \times \left(\sum_j y_{j+k}^2\right)}}, \quad k = 0, 1, 2, \ldots K_{max} \tag{1}$$

where j is calculated over the range [0, OI], where OI is the length of the overlap, x is the analysis block, and y is the synthesis block. The maximum R(k) is the synchronisation point.

In terms of processing, this requires 3×OI multiply accumulates (macs), one multiply, one divide and one square root operation per k value. As the maximum overlap that is considered workable is 0.95N, the procedure can result in a huge computational load.

Ideally the range of k should be greater than or equal to one pitch period of the lowest frequency that is to be synchronised. The proposed value for $K_{MAX}$ in the present case is 448 samples. This gives an equivalent pitch synchronising period of approximately 100 Hz. This has been determined experimentally to result in suitable audio quality for the desired application. For this k value, the normalised cross correlation search could require up to approximately 3 million macs per frame. The solution to this excessive number of operations consists of a profiling stage and a sparse cross correlation stage, both of which are discussed below.

Both the analysis and synthesis blocks are profiled. This stage consists of searching through the data blocks to find zero crossings and returning the locations and magnitudes of the local maxima and minima between each pair of zero crossings. Each local maxima (or minima) is defined as a profile point. The search is terminated when either the entire data block has been searched, or a maximum number of profile points ($P_{max}$) have been found.

Figure 5:
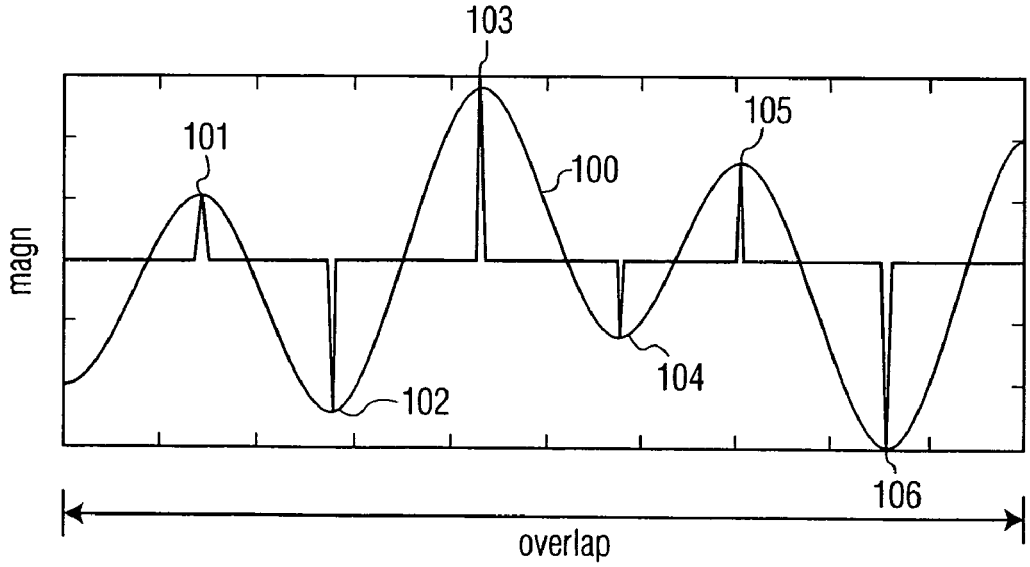
FIG. 5 represents the generation of a sparse matrix representation of an audio signal segment for subsequent cross correlation.

The profile information for the synthesis vector is then used to generate a matrix, S with length equal to the profile block, but with all elements initially set to zero. The matrix is then sparsely populated with non-zero entries corresponding to the profile points. Both the synthesis block 100 and S are shown in FIG. 5.

It is clear from this example that the synthesis block has been replaced by a matrix S which contains only six non-zero entries (profile points) as shown at 101–106.

In order to determine the local maxima (or minima) between zero crossings, the conditions for a zero crossing must be clearly defined. Subjective testing with various configurations of zero crossing have led to the following definition of a zero crossing as occurring when there is either:

a change in sign from a positive non-zero number to a negative non-zero number, and vice versa; or there is an element with a magnitude of exactly zero.

Transitions from positive to zero or from negative to zero are not included in the definition.

Turning now to calculating the sparse cross correlation, the steps involved are as follows. Firstly, both the analysis and synthesis waveforms are profiled. This results in two 2-D arrays $X_p$ and $Y_p$ respectively, of the form $x_p$(loc, mag), where:

$x_p(0,0)$=location of first maxima (minima), $x_p(0,1)$=magnitude of first maxima (minima).

Each column of the profiled arrays contains the location of a local maxima (or minima) and the magnitude of the maxima (or minima). These arrays have length=$P_{analysis}$ or $P_{synthesis}$, and a maximum length=$P_{max}$, the maximum number of profile points.

A 1-D synthesis vector S (which has length=length of synthesis buffer) is populated with zeros, except at the locations in $y_p(i,0)$, where i=0,1, . . . $P_{synthesis}$, where it is populated with the magnitude y(i,1).

The sparse cross correlation now becomes:

$$R'(k) = \frac{\sum_{i=0}^{Panalysis-1} x(i,1) \times s(x(i,0)+k)}{\left(\sum_{i=0}^{Panalysis-1} x(i,1)^2\right)\left(\sum_{i=0}^{Ploc-1} s(i+k)^2\right)} \quad (2)$$

where $P_{loc}$ is the number of synthesis points that lie within the range [0+k, OI+k].

As can be seen, the square root has been removed. Also it can be seen that the energy calculation $$\sum_{j}^{P_{analysis}} x_j^2$$

only needs to be calculated once a frame and so can be removed from equation 2.

The resulting number of macs required per frame is now limited by the maximum number of analysis profile points ($P_{max}$): in a preferred implementation, $P_{max}$=127, which has been found to provide ample resolution for the search. This means that for each frame, the Worst Case Computational Load per frame=2×127×448 is limited now by $P_{max}$, as opposed to OI. The improvement factor can be approximated by OI/$P_{max}$ which, for an overlap of 2048 samples, results in a reduction of the computational load by a factor of approximately 10. There is an additional load of approximately 12.5 k cycles per frame, but this is of the order of 20 to 30% improvement in computational efficiency. Both objective and informal subjective tests performed on the present method and SOLA algorithm produced similar results.

Considering now the issue of buffer management for the TSM process, overlapping the frames to within a tolerance of $K_{max}$ adds the constraint that the synthesis buffer must have length=OI+$K_{max}$. As this is a real-time system, another constraint is that the time scale block must output a minimum of N' samples every frame. To allow for both constraints the following buffer management is implemented. The cases for pitch increases and pitch decreases are different and so will be discussed separately.

Considering pitch increase initially, FIG. 6 shows the process of time expansion with pitch synchronisation. It is apparent from the diagram that if k= $K_{max}$, the length of the time extended frame will be less than N'. To solve this, StOI is simply increased by $K_{max}$. This results in spare samples (in the range [0, $K_{max}$]) at the end of the frame. These samples are stored in a buffer and added on to the start of the next frame as shown in FIG. 7. This results in a variable length ($N_{actual}$) for the current input frame, so the scale factor (i.e. N'I $N_{actual}$) must be recalculated every frame. If for a given frame N ever exceeds N', then N' samples from the input frame are outputted and any remaining samples are added onto the start of the next frame.

Turning now to pitch decrease, in this case samples remaining from the previous frame are stored and overlapped and added to the start of the current frame. The analysis block is now the start of the current frame, and the synthesis block is comprised of samples from the previous frame. Again, the synthesis block must have length greater than OI+$K_{max}$−1. If the synthesis block is less than this length it is simply added onto the start of the current input frame. N' samples are outputted, and the remaining samples are stored to be synchronously overlap added to the next frame. This procedure guarantees a minimum of N' samples every frame.

In order to allow a smooth transition between frames a linear cross fade is applied over the overlap. This cross fade has been set with two limits; a minimum and a maximum length. The minimum length has been determined as the length below which the audio quality deteriorates to an unacceptable level. The maximum limit has been included to prevent unnecessary load being added to the system. In this implementation, the minimum cross fade length has been set as 500 samples and the maximum has been set at 1000 samples.

A further simplification that may be applied to improve the efficiency of the sparse cross correlation will now be described with reference to the tables of FIGS. 8 and 9.

Consider first the table of FIG. 8 which shows the results of profiling the analysis and synthesis frames. Arrays Sp and Ap are created (from the synthesis and analysis frames respectively), each of which holds a maximum of 127 profile entries, each entry containing the magnitude of the profile point, as well as the location at which that point was found in the original analysis and synthesis frames. This is different from the earlier implementation, in that only one low entry profile array was created, and the other frame (the synthesis frame) was represented by a sparsely populated array of the same size as the original frame. As can be seen from the Figure, each array is terminated with −1 in the location entry to indicate the profile is complete.

In order to calculate the profile, for each value of j=0 . . . K, the following is undertaken:

Initialise variables Ap_count and Sp_count to zero.

Chose either Ap or Sp (say Ap) as the initial driving array. Driving and non driving arrays d and nd are provided as pointers, which are then used to point to whichever of Ap or Sp are the driver for a particular iteration through the algorithm. These also hold values d_count and nd_count, which are used to hold the intermediate values of ap_count and sp_count whilst a particular array is serving as the driving array.

It will be noted that, depending upon which array is the driving array, in practice either the .loc or .loc+k value is used in later calculations. This may be done efficiently, for example, by always adding j*gate to the .loc value, and gate is a value either 0 or 1 depending upon whether the analysis frame is chosen. So, d_gate and nd_gate, hold these gate values and when the driving array pointer is swapped the gate values should also be swapped Hence a comparison of the .loc values of the driving and non-driving arrays will be:

Is driving[d_count].loc+j*d_gate>non_driving[nd_count].loc+j*nd_gate

So, starting to perform an iteration.

Compare driving[d_count].loc+j*d_gate with non_driving[nd_count].loc+j*nd_gate.

If the two locations match, either perform the cross correlation summations now, or else add the Ap and Sp magnitude values (accessed in the same manner as the .loc values) to a list of 'values to multiply later'. Increment Sp_count and Ap_count (d count and nd_count), and pick a new driving array by finding the maximum of the numbers Ap[Ap_count].loc, Sp[Ap_count].loc+j (if the two match then pick either), thus giving a new driving array to guide the calculations.

If the values do not match, then:

if the .loc value in the driving array is greater than the .loc value in the non-driving array, then increment the count value of the non driving array.

If the .loc of the driving array is less than the .loc of the non-driving array then increment the_count value of the driving array Make the driving array the one with the higher loc value, unless both are the same, in which case do nothing.

Now perform a new iteration and continue with this until either array is −1 terminated, indicating one of the profile arrays is exhausted. If the multiplications were not performed during the above phase, the list of magnitude values to multiply together should now be extracted and the cross-correlation calculated. In the example above, the process is illustrated for j= 1.

In the above approach only two multiplications are carried out j=1, as compared to a total of 4 which would have been required in a dumb implementation, with the added complexity of the implementation above. On the face of it this is an insignificant depreciation, but, as the number of profile points increase, then the scope for reducing the number of multiplications decreases further. Effectively the number of multplications that are carried out is bounded by the smaller of the number of points in either profile array, as opposed to being bounded by the number in the analysis array as in the earlier implementation, which gives potential for high gains.

Although defined principally in terms of a software implementation, the skilled reader will be well aware than many of the above-described functional features could equally well be implemented in hardware. Although profiling, used to speed up the cross correlation, dramatically reduces the number of macs required, it introduces a certain amount of pointer arithmetic. Processors such as the Philips Semiconductors TriMedia™, with its multiple integer and floating point execution units, is well suited to implementing this floating point arithmetic efficiently in conjunction with floating point macs.

The techniques described herein have further advantage on TriMedia in that it makes good use of the TriMedia cache. If a straightforward cross correlation were undertaken, with frame sizes of 2*2048, it would require 16 k data, or a full cache. As a result there is likely to be some unwanted cache traffic. The approach described herein reduces the amount of data to be processed as a first step, thus yielding good cache performance.

From reading the present disclosure, other modifications will be apparent to persons skilled in the art. Such modifications may involve other features which are already known in the design, manufacture and use of image processing and/or data network access apparatus and devices and component parts thereof and which may be used instead of or in addition to features already described herein.

What is claimed is:

1. A method of time-scale modification processing of frame-based digital audio signals wherein, for each frame of predetermined duration comprising:

the original frame of digital audio is copied;

the original and copied frames are partly overlapped to give a desired new duration to within a predetermined tolerance;

the extent of overlap is adjusted within the predetermined tolerance by reference to a cross correlation determination of the best match between the overlapping portions of the original and copied frame; and a new audio frame is generated from the non-overlapping portions of the original and copied frame and by cross-fading between the overlapping portions;

characterised in that a profiling procedure is applied to the overlapping portions of the original and copied frame prior to cross correlation, which profiling procedure reduces the specification of the respective audio frame portions to respective finite arrays of containing less than 128 values, and the cross correlation is then performed in relation only to the pair of finite arrays of values.

2. A method as claimed in claim 1, wherein for the said overlapping portions the profiling procedure identifies periodic or a periodic maxima and minima of the audio signal portions and places these values in said respective arrays.

3. A method as claimed in claim 2, wherein the overlapping portions are each specified in the form of a matrix having a respective column for each audio sampling period within the overlapping portion and a respective row for each discrete signal level specified, and the cross correlation is applied to the pair of matrices.

4. A method as claimed in claim 3, wherein a median level is specified for the audio signal level, and said maxima and minima are specified as positive or negative values with respect to said median value.

5. A method as claimed in claim 3, wherein prior to cross correlation, at least one of the matrices is converted to a one-dimensional vector populated with zeros except at maxima or minima locations for which it is populated with the respective maxima or minima magnitude.

6. A method as claimed in claim 1, wherein the predetermined tolerance within which the overlap between the original and copied frames may be adjusted is based on the pitch period of the audio signal for the original frame.

7. A method as claimed in claim 4, wherein the maxima or minima are identified as the greatest recorded magnitude of the signal, positive or negative, between a pair of crossing points of said median value.

8. A method as claimed in claim 7, wherein a zero crossing point for said median value is determined to have occurred when there is a change in sign between adjacent digital sample values.

9. A method as claimed in claim 7, wherein a zero crossing point for said median value is determined to have occurred when a signal sample value exactly matches said median value.

10. A digital signal processing apparatus arranged to apply the time scale modification processing method of claim 1 to a plurality of frames of stored digital audio signals, the apparatus comprising storage means arranged to store said audio frames and a processor programmed, for each frame, to perform the steps of:

copying an original frame of digital audio and partly overlapping the original and copied frames to give a desired new duration to within a predetermined tolerance;

adjusting the extent of overlap within the predetermined tolerance by applying a cross correlation to determine the best match between the overlapping portions of the original and copied frame; and generating a new audio frame from the non-overlapping portions of the original and copied frame and by cross-fading between the overlapping portions;

characterised in that the processor is further programmed to apply a profiling procedure to the overlapping portions of the original and copied frame prior to cross correlation to reduce the specification of the respective audio frame portions to respective finite arrays of values, and apply the cross correlation in relation only to the pair of finite arrays of values.

11. A method of time-scale modification processing of frame-based digital audio signals wherein, for each frame of predetermined duration comprising:

copying an original frame of digital audio;

overlapping the original and copied frames by a predetermined amount;

adjusting overlapping portions of the original and copied frames in accordance with a cross correlation determination of the best match between the overlapping portions of the original and copied frame; and generating a new audio frame from the non-overlapping portions of the original and copied frame and by cross-fading between the overlapping portions;

characterised in that a profiling procedure is applied to the overlapping portions of the original and copied frame prior to cross correlation, which profiling procedure reduces the specification of the respective audio frame portions to a pair of respective finite arrays of containing less than 128 values.

12. A method as claimed in claim 11, wherein, and the cross correlation is performed in relation to the pair of finite arrays of values.

13. A method as claimed in claim 11, wherein for the overlapping portions of the profiling procedure identifies periodic maxima or a periodic minima of the audio signal portions and places these values in said respective arrays.

14. A method as claimed in claim 13, wherein the overlapping portions are each specified in the form of a matrix having a respective column for each audio sampling period within the overlapping portion and a respective row for each discrete signal level specified, and the cross correlation is applied to the pair of matrices.

15. A method as claimed in claim 14, wherein a median level is specified for the audio signal level, and said maxima and minima are specified as positive or negative values with resect to said median value.

16. A method as claimed in claim 14, wherein prior to cross correlation, at least one of the matrices is converted to a one-dimensional vector populated with zeros except at maxima or minima locations for which it is populated with the respective maxima or minima magnitude.

17. A method as claimed in claim 11, wherein the predetermined tolerance within which the overlap between the original and copied frames may be adjusted is based on the pitch period of the audio signal for the original frame.

18. A method as claimed in claim 15, wherein the maxima or minima are identified as the greatest recorded magnitude of the signal, positive or negative, between a pair of crossing points of said median value.

19. A method as claimed in claim 18, wherein a zero crossing point for said median value is determined to have occurred when there is a change in sign between adjacent digital sample values.

20. A method as claimed in claim 18, wherein a zero crossing point for said median value is determined to have occurred when a signal sample value exactly matches said median value.

* * * * *